US006745949B2

(12) United States Patent
Lee

(10) Patent No.: US 6,745,949 B2
(45) Date of Patent: Jun. 8, 2004

(54) DRINKING STRAW WITH VALVE FUNCTION

(76) Inventor: Kyou Sang Lee, 104-904 Daewoo Utipia Apt. 499 Abang-dong, Gimhae, Gyungsangnam-do (KR), 621-752

( * ) Notice: Subject to any disclaimer, the term of this patent is extended or adjusted under 35 U.S.C. 154(b) by 152 days.

(21) Appl. No.: 10/172,898

(22) Filed: Jun. 17, 2002

(65) Prior Publication Data

US 2003/0006293 A1 Jan. 9, 2003

(30) Foreign Application Priority Data

Jun. 26, 2001 (KR) ..... 2001-19170
May 7, 2002 (KR) ..... 2002-25079

(51) Int. Cl.[7] ..... A47G 19/22; A47G 21/18

(52) U.S. Cl. ..... 239/33; 239/29; 220/709; 220/710; 220/714; 220/705; 229/103.1; 215/229; 215/388

(58) Field of Search ..... 239/33, 24, 29; 215/229, 388, 387; 220/714, 709, 705, 703, 906, 254.1, 254.3, 254.7; 229/103.1; 222/529, 530, 538; 251/342

(56) References Cited

U.S. PATENT DOCUMENTS 2,392,479 A * 1/1946 Humbert ..... 229/103.1
2,948,453 A * 8/1960 Drown ..... 229/103.1
2,957,614 A * 10/1960 Krajcovic ..... 229/103.1
3,438,527 A * 4/1969 Berry, Jr. ..... 215/388
4,714,173 A * 12/1987 Ruiz ..... 220/709
4,782,975 A * 11/1988 Coy ..... 220/711
4,828,141 A * 5/1989 Coy ..... 220/380
4,836,404 A * 6/1989 Coy ..... 220/714
5,109,995 A * 5/1992 Lou ..... 215/388
5,201,460 A * 4/1993 Caines ..... 229/103.1
5,234,117 A * 8/1993 Garvin ..... 215/11.4
5,253,779 A 10/1993 Lee ..... 220/705
5,353,983 A 10/1994 Miller ..... 229/103.1
5,381,924 A * 1/1995 Kiefel ..... 220/709
5,582,320 A * 12/1996 Lin ..... 220/708
5,671,863 A * 9/1997 Uliana ..... 220/710
6,073,860 A 6/2000 Coppock ..... 239/33
6,116,446 A 9/2000 Haughton et al. ..... 215/355
6,196,413 B1 * 3/2001 Tung ..... 220/709
6,227,403 B1 * 5/2001 Kim ..... 220/707
6,293,394 B1 * 9/2001 Marbler et al. ..... 206/218
6,360,912 B1 * 3/2002 Lee ..... 220/705
6,457,597 B2 * 10/2002 Hirota et al. ..... 220/258.2
6,494,332 B1 * 12/2002 Haughton et al. ..... 215/355

* cited by examiner

*Primary Examiner*—Patrick Brinson
(74) *Attorney, Agent, or Firm*—Kinney & Lange, P.A.

(57) ABSTRACT

Disclosed is a drinking straw with valve function adapted to be mounted to a beverage container, the straw including a straw member having a straw body, a bellows portion formed at a desired portion of the straw body, and a tube arranged in the bellows portion while being integral with the straw body and having a desired elasticity, and a straw mounting member for mounting the straw member to the beverage container. The straw mounting member includes a fixed base attached to a top of the beverage container while being in close contact with the top of the beverage container, a straw fitting section formed at one side portion of the fixed base, and adapted to mount the straw member thereto, and a straw holding section formed at the other side portion of the fixed base, and adapted to hold the straw member in a bent state or to release the straw member from the bent state. A cut-out is selectively formed at an inner tube portion of the tube in a region where the inner tube portion bends. The cut-out has a desired shape while serving to provide an improved passage closing function when the bellows portion bends.

8 Claims, 11 Drawing Sheets

DRINKING STRAW WITH VALVE FUNCTION

BACKGROUND OF THE INVENTION

1. Field of the Invention

The present invention relates to a drinking straw with valve function, and more particularly to a drinking straw with valve function, in which a tube serving as a valve is arranged inside a bellows portion included in the straw, in order to selectively open and close a passage defined in the straw, thereby controlling spouting of the liquid from the beverage container, so that the straw can serve as a tap for the beverage container, as well as its original straw function.

2. Description of the Related Art

Rod-shaped drinking straws are well known. A rod-shaped drinking straw is typically configured to have a hollow rod shape having a passage extending throughout the straw. Since the straw extends linearly, a user can drink liquid contained in a beverage container only when the user's mouth is aligned with the container. For this reason, such straw is inconvenient to use in drinking liquid. Furthermore, it may damage the user's throat or mouth. In order to solve these problems, a drinking straw has been developed, which is provided at a substantially central portion thereof with bellows to adjust orientation of the straw, thereby also adjusting spouting direction of the straw.

Although each of the above mentioned conventional drinking straws allows a user to drink in a stable way a desired volume of liquid contained in a beverage container, it still is disadvantageous in that the container has an outlet of which size is considerably larger than that of the straw, defining a gap between the outlet and the straw, thereby resulting in spillage of liquid from the container through the gap if the container is tipped over. In addition, since the straw floats in the container, the user has to hold it by hand while drinking, which is inconvenient. Furthermore, the passage of the straw is always in an open state. For this reason, liquid may unintentionally flow from the container through the open passage of the straw in the event of an impact unintentionally applied to the container when the user drinks the beverage using the straw while walking or riding in a car. In this case, the spouted liquid may contaminate the user's clothes. Additionally, liquid contained in the container may be polluted by foreign matters, such as dust, possibly introduced into the container through the gap between the outlet and the straw.

In order to solve the above mentioned problems, the applicant proposed a straw having a valve function. This straw is disclosed in U.S. Pat. No. 6,360, 912, and also illustrated in FIG. 1, bearing a reference numeral 100.

As shown in FIG. 1, the straw 100, which has a basic configuration including a straw body 110 defined therein with a passage extending throughout the length of the straw body 110, and a bellows portion 120 formed at a desired portion of the straw body 110 while having a desired length, includes a tube 130 arranged in the bellows portion 120 and integrally formed with the straw body 110 while having a desired elasticity. When the upper portion of the straw body 110 rotates downwardly, the bellows portion 120 bends as shown in FIG. 2*a*, causing the tube 130 to bend, subsequently allowing opposite inner surface portions thereof to come into close contact with each other. As a result, the passage of the straw body 110 is closed, thereby preventing liquid contained in the container from flowing outwardly through the straw 100.

In order to apply the straw of FIG. 1 to a beverage container, it is necessary to mount the coupling and holding members to the beverage container. However, the coupling and holding members need to be manufactured separately, which requires a complex manufacturing process. Furthermore, such straw is not easy to mount, is inconvenient to use and also does not look very good. Although a user can conveniently use the straw by selectively opening or closing the straw of FIG. 1 because of the valve function provided by the tube arranged inside the bellows portion 120, rotating the straw in an upward or downward direction for opening or closing the straw is not that easy because the straw has an increased thickness due to the provision of the tube inside the bellows portion 120. Although the bellows portion 120 bends only by an angle of about 90°, as shown in FIG. 2*b*, the inner and outer portions 132 and 134 of the tube 130 come into contact with each other while bending. At this time, the inner portion 132 of the tube 130 bends while having a certain radius of curvature, whereas the outer portion 134 of the tube 130 is tightly strained at opposite ends thereof while maintaining a substantially planar shape. That is, the inner and outer portions 132 and 134 of the tube 130 are in contact with each other along a narrow area. Consequently, the contact force between inner and outer tube portions 132 and 134 becomes weak. For this reason, the pressure generated in the beverage container in the event of an external force applied to the beverage container may easily exceed the force maintaining contact between the inner and outer tube portions 132 and 134. In other words, liquid may easily spout from the beverage container through the tube 130 if an excessive external force is applied to the beverage container.

SUMMARY OF THE INVENTION

Therefore, the present invention has been made in view of the above mentioned drawbacks, and an object of the invention is to provide a drinking straw with valve function, which has an improved mountability to a beverage container, is convenient to use, and has an improved appearance.

Another object of the invention is to provide a drinking straw with valve function, of which configuration allows easy manipulation of the straw as well as an improved performance for closing a passage defined in the straw.

In accordance with one aspect, the present invention provides a drinking straw with valve function adapted to be mounted to a beverage container, the straw comprising a straw member including a straw body, a bellows portion formed at a desired portion of the straw body, and a tube arranged in the bellows portion while being integral with the straw body and having a desired elasticity, further comprising: a straw mounting member for mounting the straw member to the beverage container, the straw mounting member including a fixed base attached to a top of the beverage container while being in close contact with the top of the beverage container, a straw fitting section formed at one side portion of the fixed base, and adapted to mount the straw member thereto, and a straw holding section formed at the other side portion of the fixed base, and adapted to hold the straw member in a bent state or to release the straw member from the bent state.

In accordance with another aspect, the present invention provides a drinking straw with valve function comprising a hollow straw body having a passage defined therein, a bellows portion formed at the straw body while having a desired length, and a tube arranged in the bellows portion, further comprising: a cut-out formed at an inner tube portion of the tube in a region where the inner tube portion bends, the cut-out having a desired shape while serving to provide an improved passage closing function when the bellows portion bends.

BRIEF DESCRIPTION OF THE DRAWINGS

The above objects, and other features and advantages of the present invention will become more apparent after a reading of the following detailed description when taken in conjunction with the drawings, in which.

DESCRIPTION OF THE PREFERRED EMBODIMENTS

Now, the present invention will be described in more detail with reference to the annexed drawings.

Figure 3:
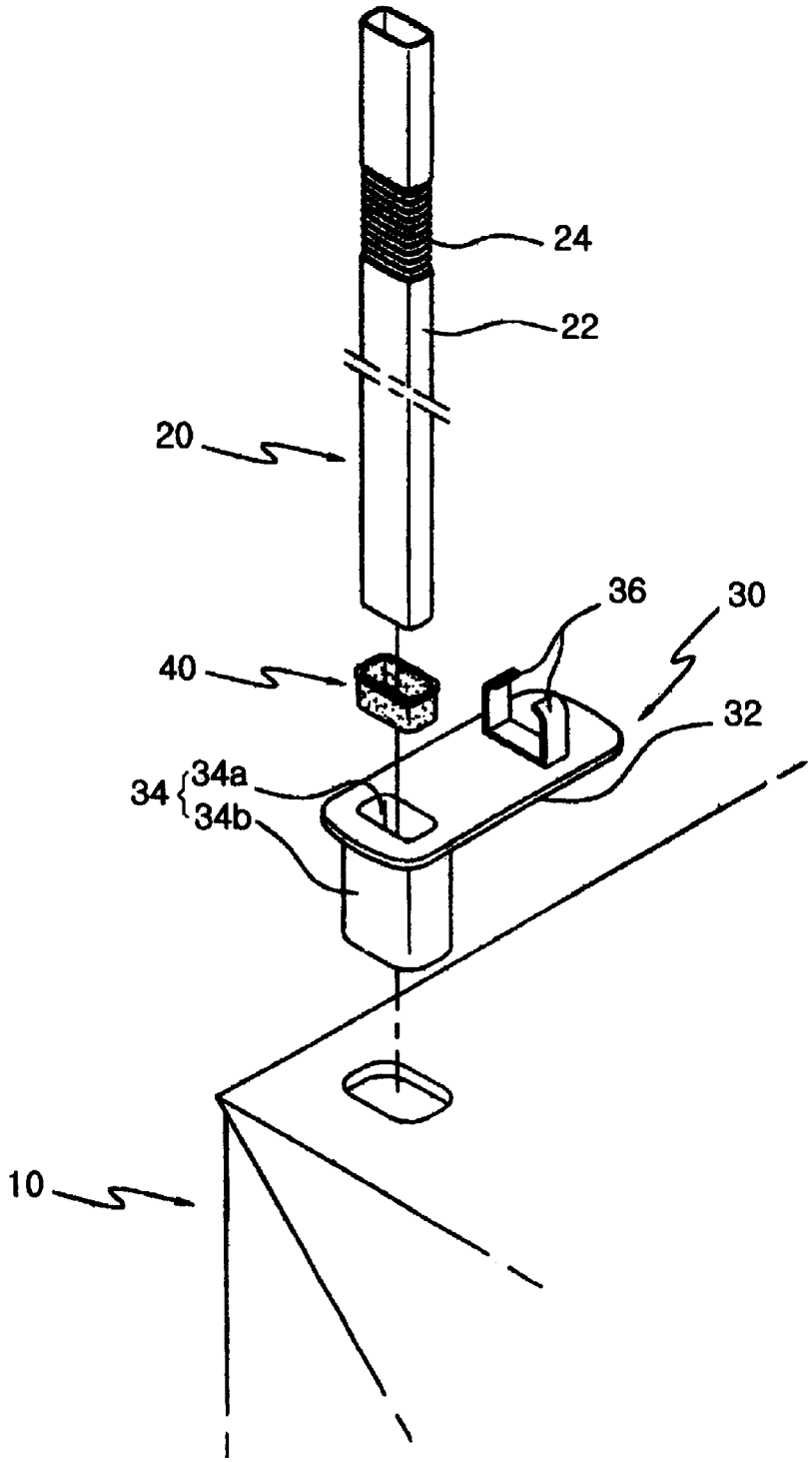
FIG. 3 is an exploded perspective view illustrating a drinking straw with valve function according to an embodiment of the present invention.

FIG. 3 is an exploded perspective view illustrating a drinking straw with valve function according to an embodiment of the present invention.

As shown in FIG. 3, the straw includes a straw member 20, and a straw mounting member 30 for mounting the straw member 20 to a beverage container 10. The straw member 20 includes a hollow straw body 22 having an elongated rod shape, a bellows portion 24 formed at a desired portion of the straw body 22, and a tube 26 arranged in the bellows portion 24 while being integral with the straw body 22 and having a desired elasticity.

The straw mounting member 30 includes a fixed base 32 attached to a top of the beverage container 10 while being in close contact with the top of the beverage container 10, a straw fitting section 34 formed at one side portion of the fixed base 32, and adapted to allow the straw member 20 to extend therethrough while fitting therein, and a straw holding section 36 formed at the other side portion of the fixed base 32, and adapted to hold the straw member 20 in a bent state or to release the straw member 20 from the bent state.

The fixed base 32 has a rectangular plate structure having round corners. The straw fitting section 34 includes a straw fitting hole 34*a* having a cross-section substantially identical to that of the straw member 20, and a protrusion 34*b* extending downwardly from the lower surface of the fixed base 32 around the straw fitting hole 34*a*. The straw holding section 36 includes a pair of hooks extending upwardly from the upper surface of the fixed base 32 while facing each other. The hooks have a desired elasticity.

Preferably, a packing member 40 is installed at the straw fitting section 34 in such a fashion that it is interposed between the inner surface of the straw fitting section 34 and the corresponding outer surface portion of the straw member 20 in order to provide an improved sealing effect between the straw and the beverage container, while firmly fitting the straw member 20 in the straw fitting section 34. The packing member 40 is preferably made of an elastic material that is highly sanitary and has no harmful effect on human body.

Although the straw member included in the straw of the present invention is illustrated as having an oval shape, it may have various shapes without being limited to the oval shape. Similarly, the shapes of the straw fitting section 34 and straw holding section 36 included in the straw mounting member 30 may be diversified without being limited to those illustrated in the drawings.

Figure 4A:
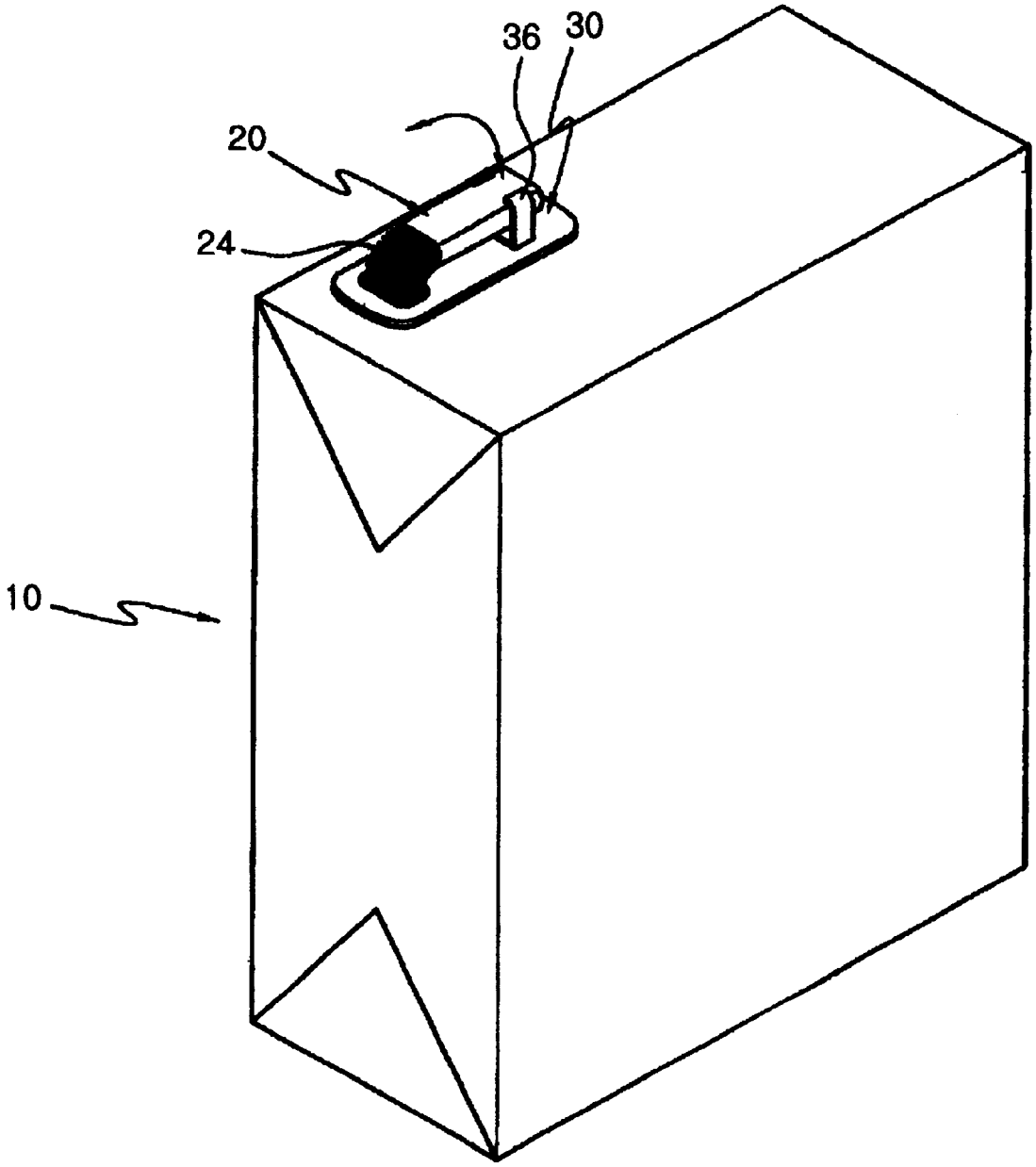
FIGS. 4*a* and 4*b* are perspective views respectively illustrating applications of the drinking straw with valve function according to an embodiment of the present invention.
Figure 4B:
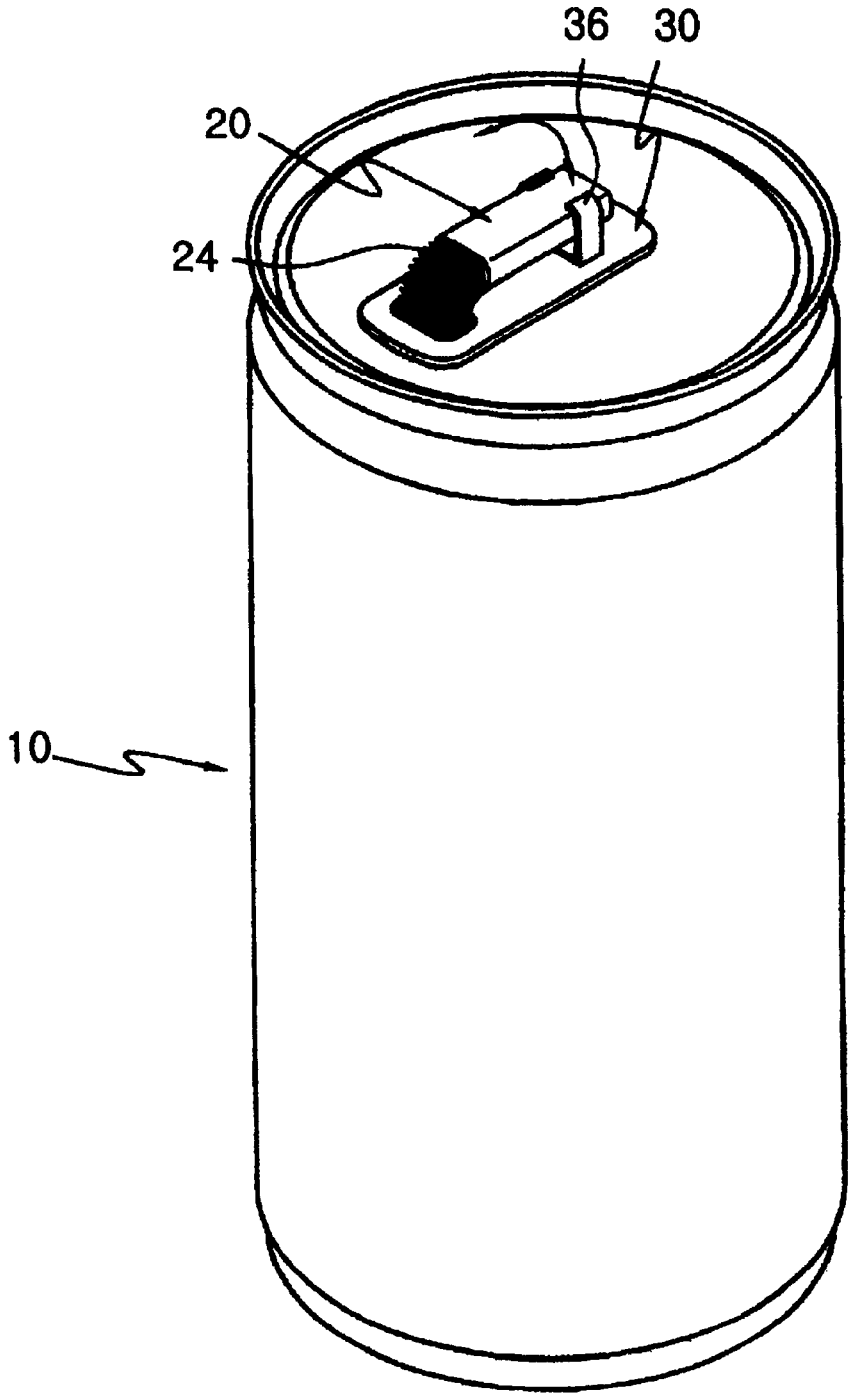

The operation of the straw having the above described configuration according to the present invention will now be described in conjunction with FIGS. 4*a* and 4*b*. As shown in FIGS. 4*a* and 4*b*, the straw mounting member 30 is mounted to the top of a beverage container 10 in the process of manufacturing the beverage container 10 or in the process of packaging the beverage to be contained in the beverage container 10. The straw member 20 is then fitted in the straw fitting section 34 of the straw mounting member 30 in such a fashion that the packing member 40 is interposed between the inner surface of the straw fitting section 34 and the corresponding outer surface portion of the straw member 20. Thus, the mounting of the straw is completed. In this state, the beverage contained in the beverage container 10 is maintained under a sealed condition.

Figure 5:
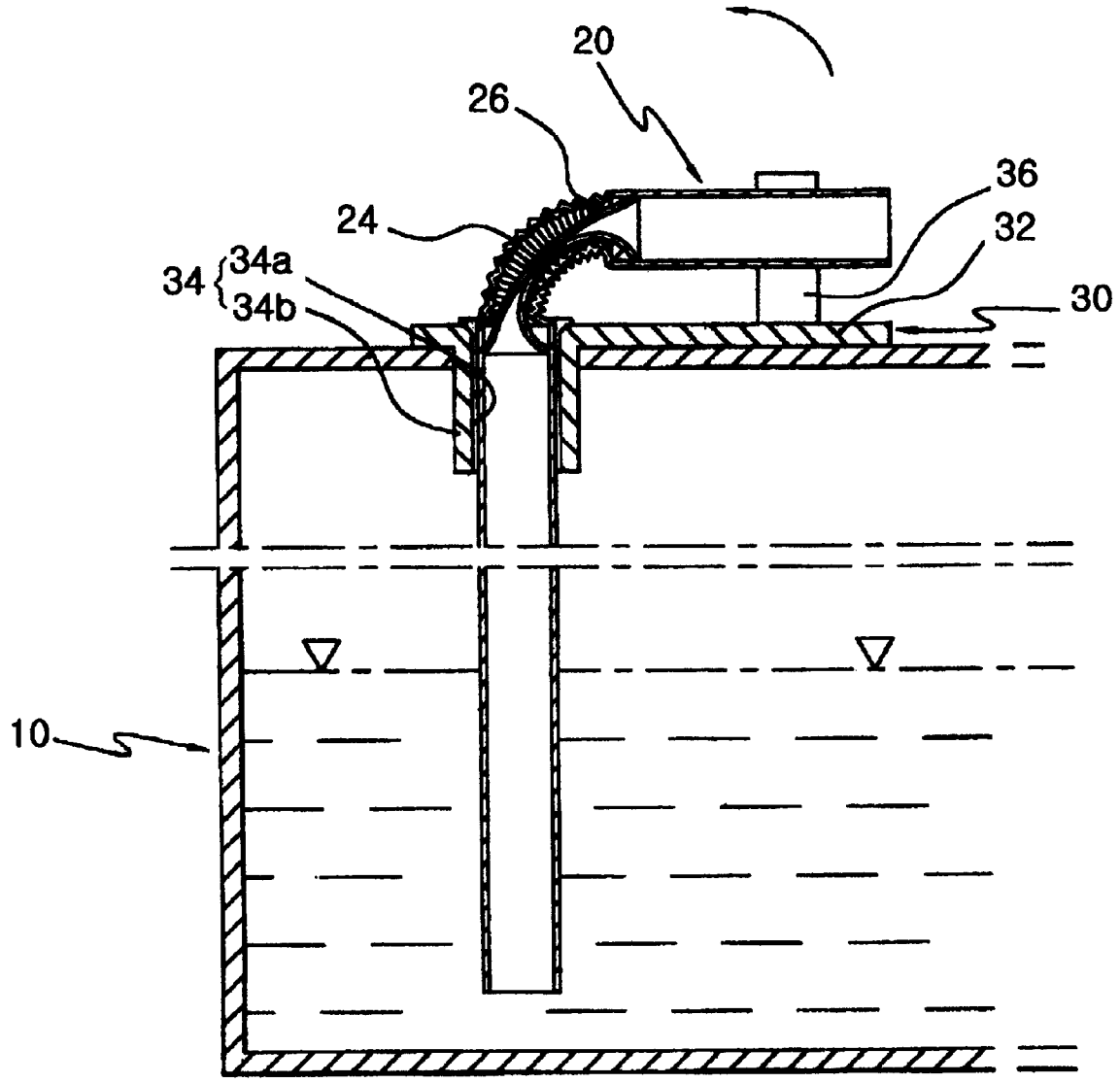
FIG. 5 is a view for explaining the operation of the drinking straw with valve function according to an embodiment of the present invention.

When force is applied to the upper portion of the straw member 20 assembled as described above, in order to bend the straw member 20, the bellows portion 24 bends, thereby allowing the upper portion of the straw member 20 to be engaged with the straw holding section 36. Thus, the upper portion of the straw member 20 is elastically held by the straw holding section 36. In this state, the tube 26 arranged inside the bellows portion 24 bends, so that it closes the passage defined in the straw member 20, as shown in FIG. 5. Accordingly, liquid contained in the beverage container 10 does not outwardly spout from the container. When a user wants to drink liquid contained in the beverage container 10 under the above described condition, the user applies, to the upper end of the straw member 20, an external force exceeding the holding force of the straw holding section 36 in order to release the upper portion of the straw member 20 from the straw holding section 36. The release force releases the upper portion of the straw member 20 from the straw holding section 36. As a result, the tube arranged inside the bellows portion 24 unbends, thereby opening the passage thereof. Accordingly, when the user applies a sucking force to the upper end of the straw member 20, liquid is sucked into the user's mouth via the opened passage. Thus, the user can drink liquid.

Figure 1:
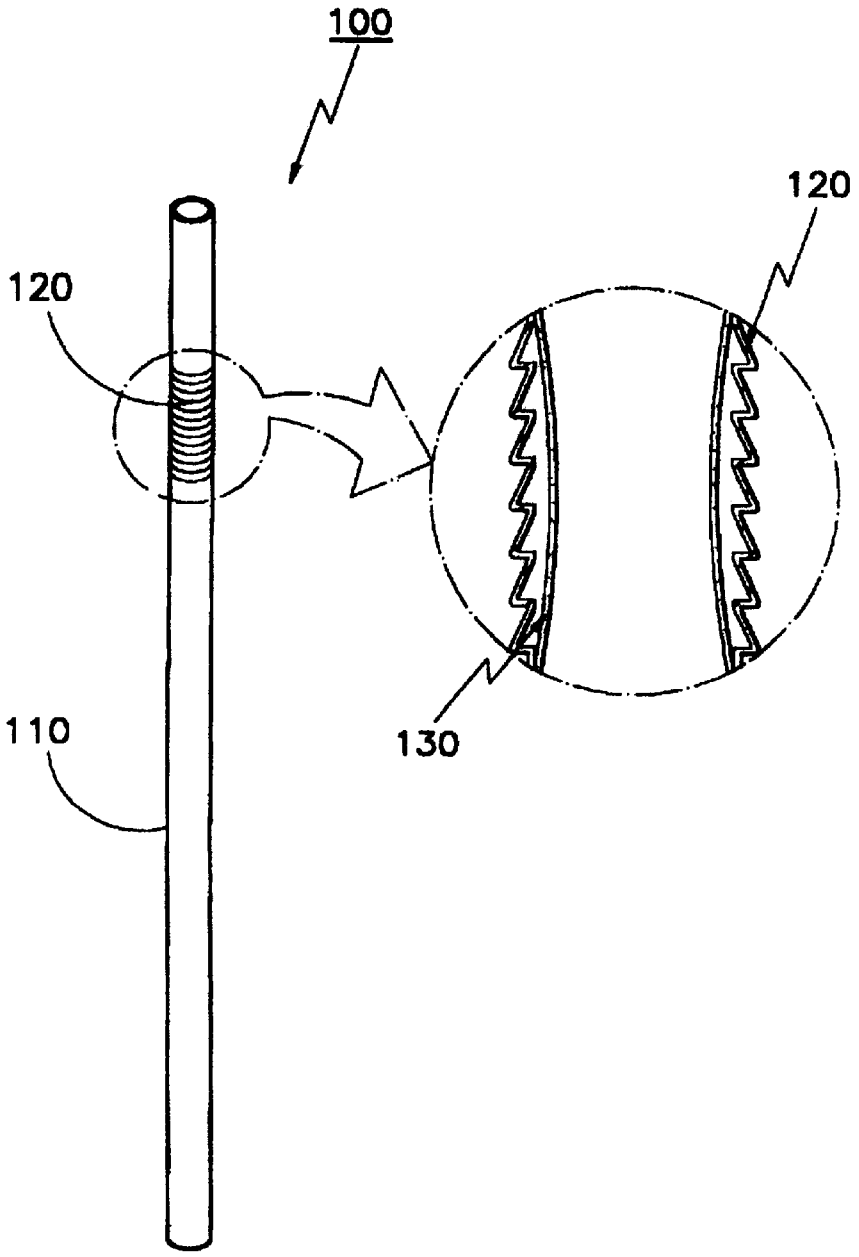
FIG.1 PRIOR ART
FIG. 1 is a perspective view illustrating a conventional drinking straw with valve function.
Figure 2A:
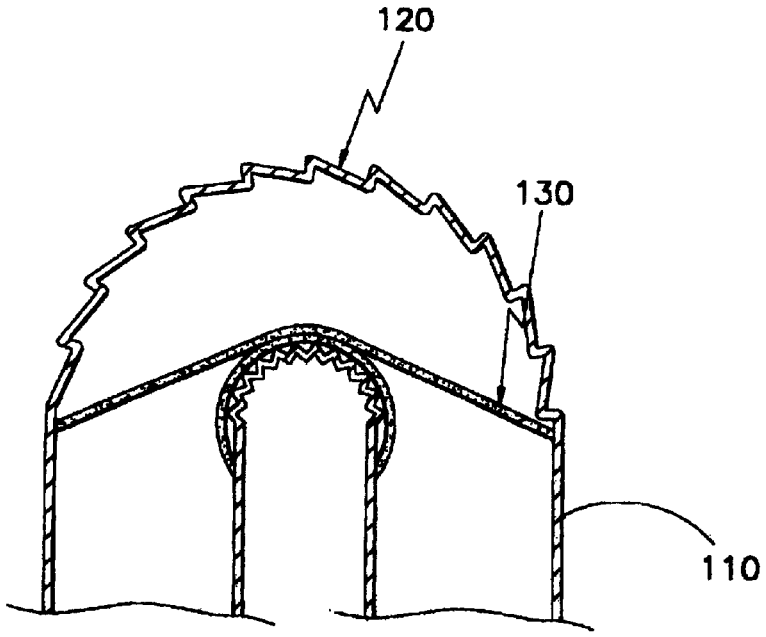
FIG.2a PRIOR ART
FIGS. 2*a* and 2*b* are views for explaining the operation of the straw shown in FIG. 1, respectively.
Figure 2B:
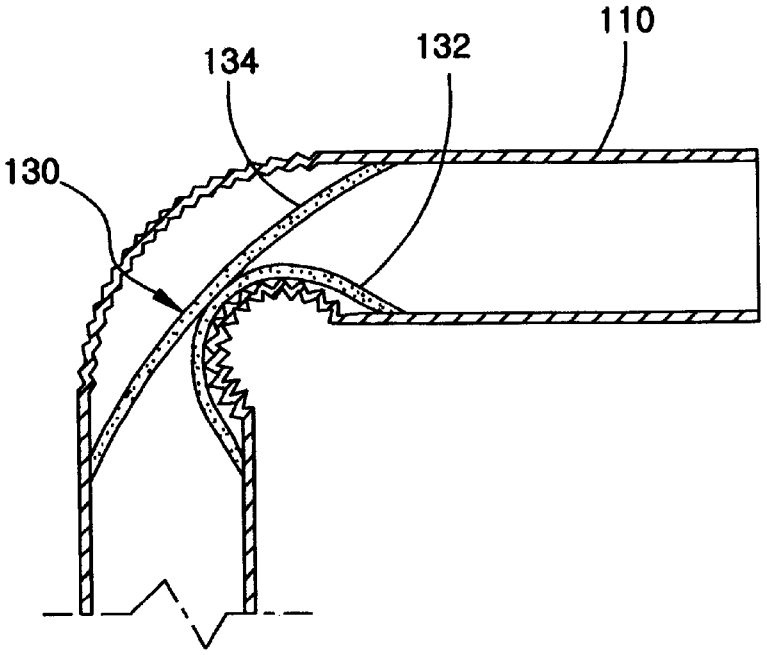
FIG.2b PRIOR ART
Figure 6:
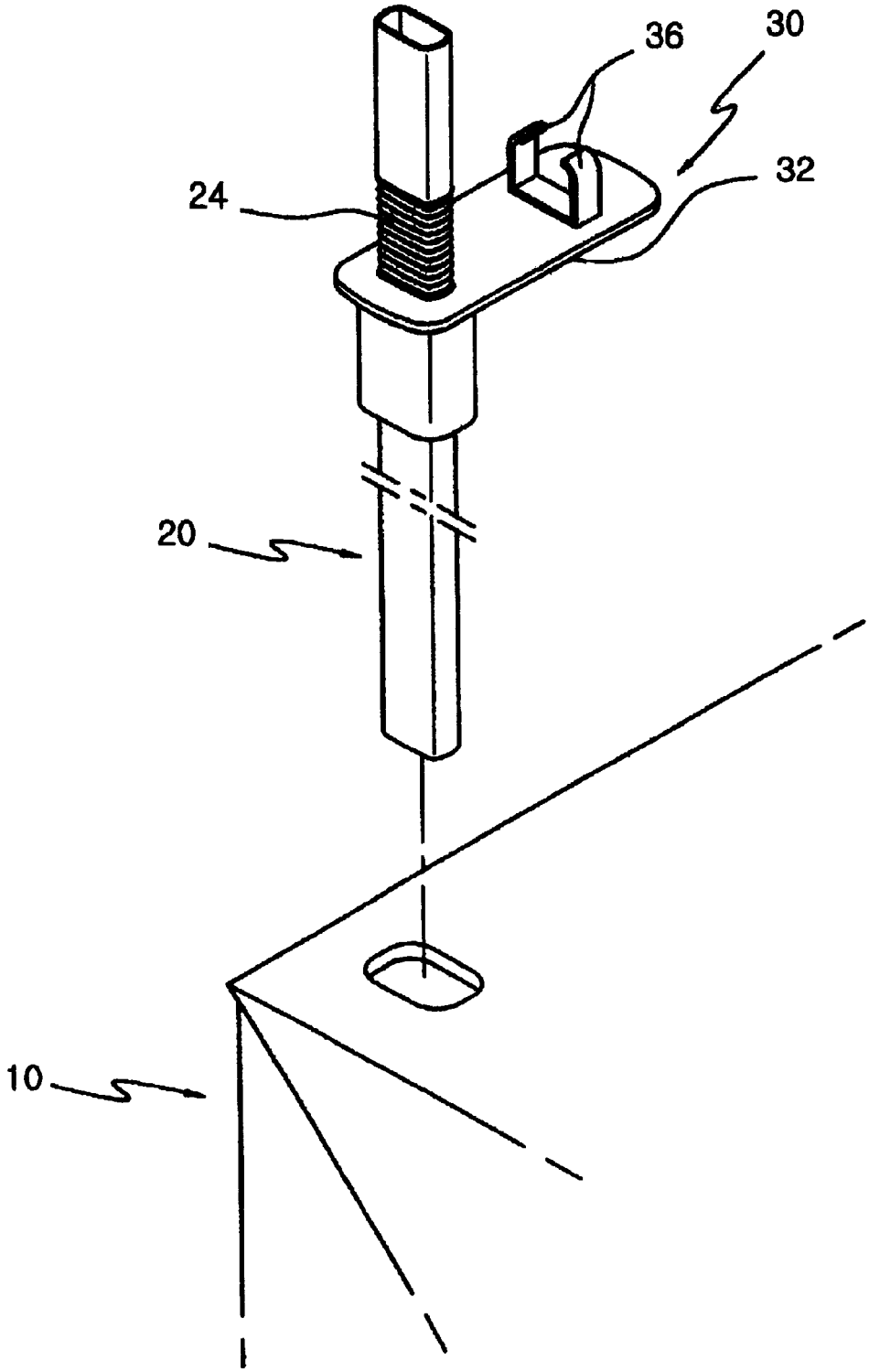
FIG. 6 is an exploded perspective view illustrating a drinking straw with valve function, which has a configuration modified from the straw according to an embodiment of the present invention.

Meanwhile, FIG. 6 is an exploded perspective view illustrating a drinking straw with valve function, which has a configuration modified from the straw of FIG. 1 according to an embodiment of the present invention. In FIG. 6, elements respectively corresponding to those in FIG. 1 are denoted by the same reference numerals. As shown in FIG. 6, the straw includes a straw member 20, and a straw mounting member 30. The straw member 20 includes a hollow straw body 22 having an elongated rod shape, a bellows portion 24 formed at a desired portion of the straw body 22, and a tube 26 arranged in the bellows portion 24 while being integral with the straw body 22 and having a desired elasticity. In this case, the straw member 20 is integral with the straw mounting member 30.

Since the straw member 20 is integral with the straw mounting member 30, the manufacturing and assembling processes are simplified by virtue of reduced number of constituting elements and therefore, the present invention brings the effect of improving the productivity and lowering the manufacturing cost, in addition to provision of the effect obtained by the straw mounting configuration according to an embodiment of the invention.

Figure 7:
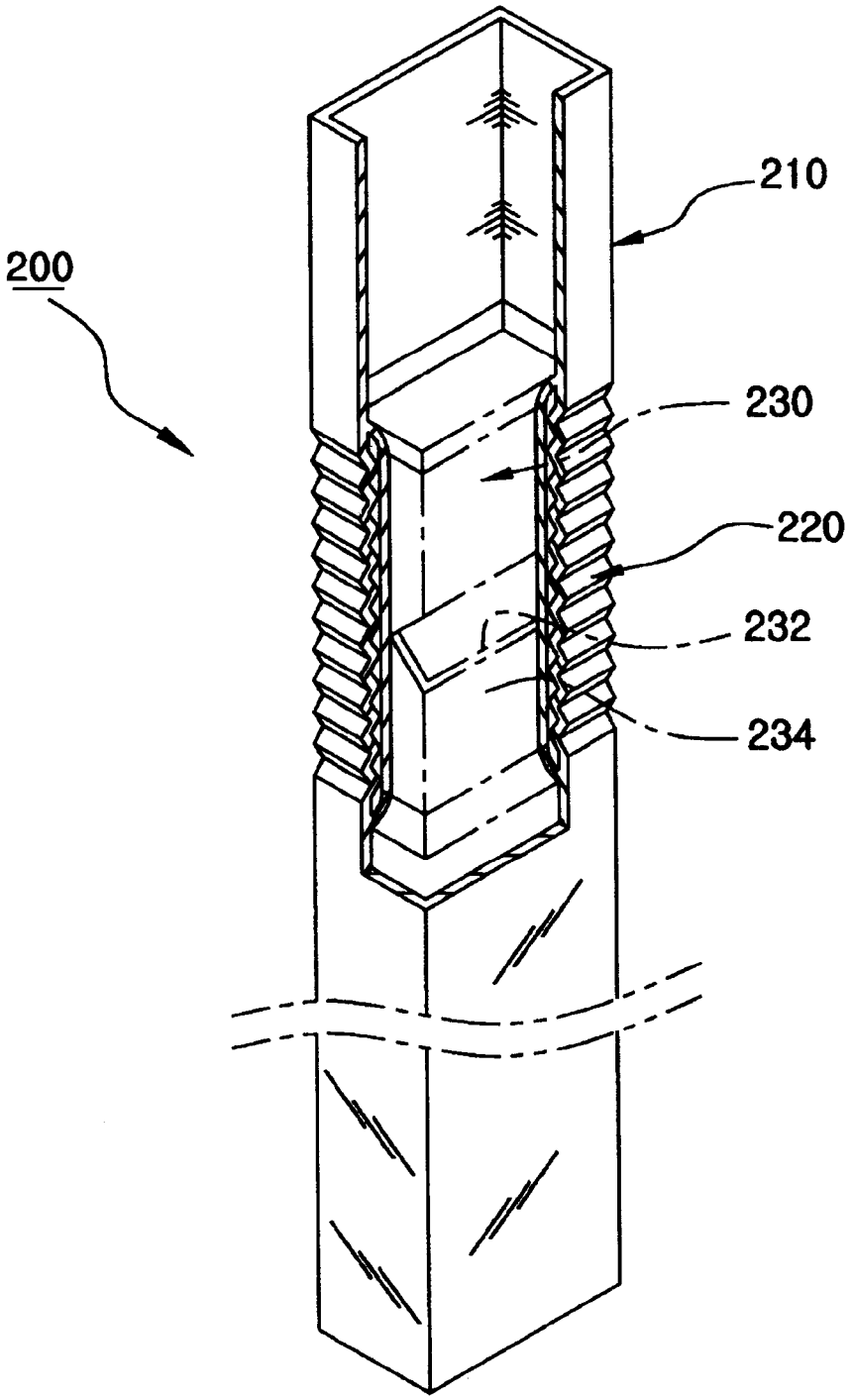
FIG. 7 is a partially-broken perspective view illustrating a drinking straw with valve function in accordance with another embodiment of the present invention.
Figure 8:
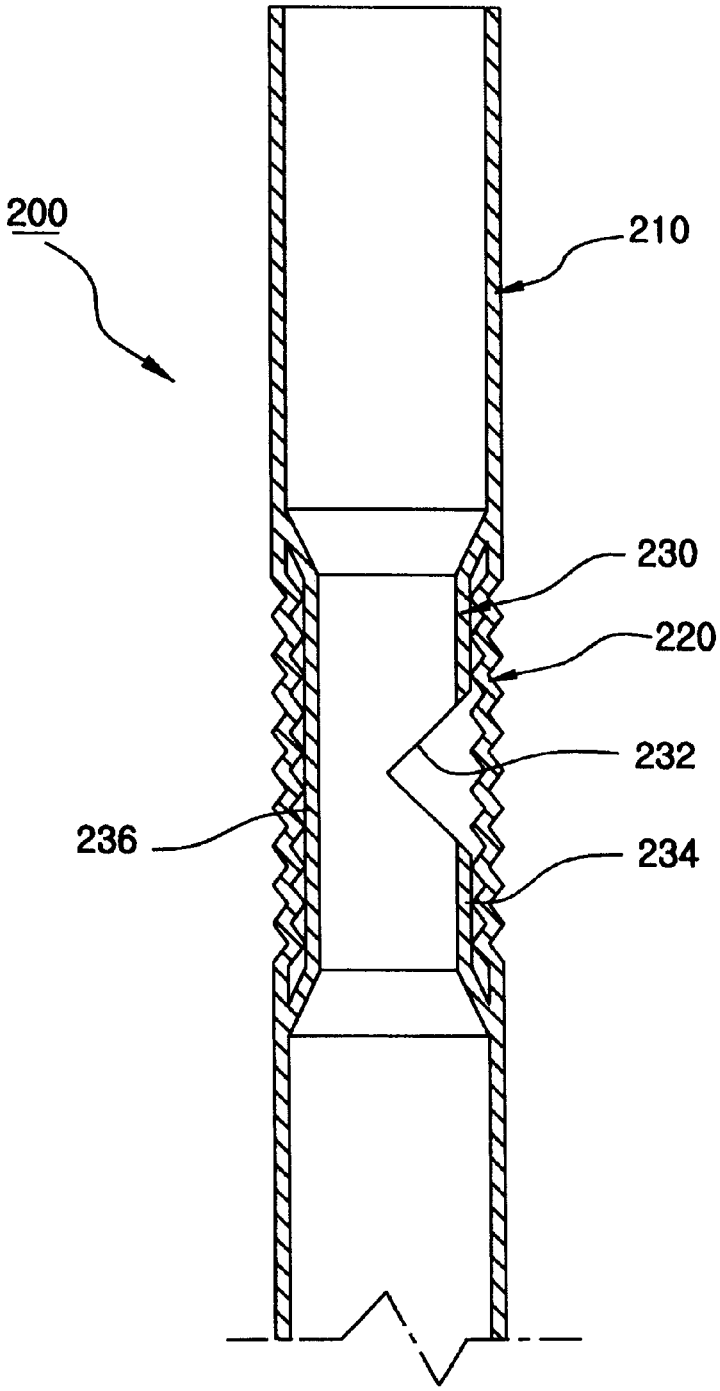
FIG. 8 is a sectional view corresponding to FIG. 7.
Figure 9:
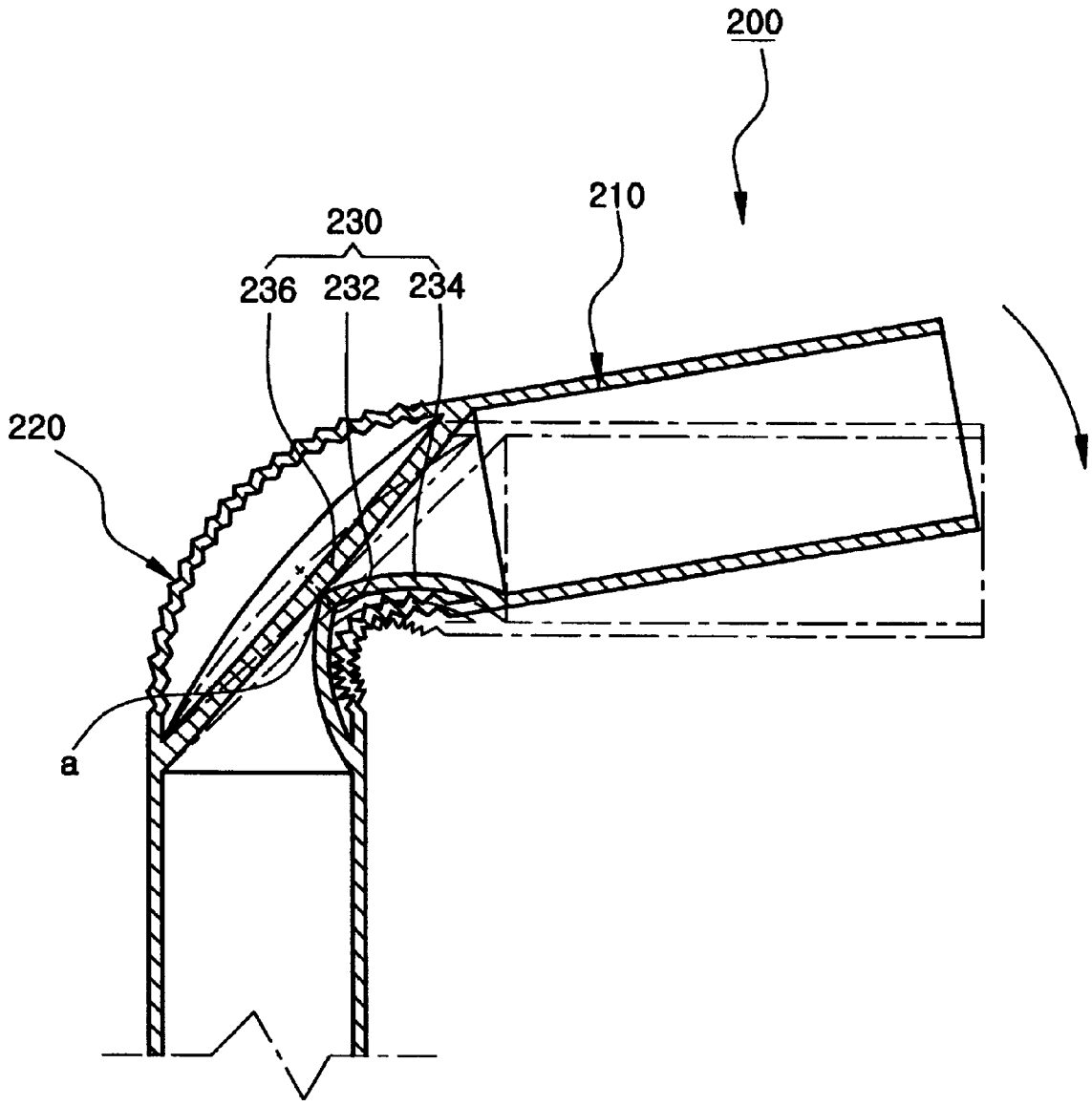
FIG. 9 is a view for explaining the operation of the drinking straw with valve function according to another embodiment of the present invention.

FIG. 7 is a partially-broken perspective view illustrating a drinking straw with valve function in accordance with another embodiment of the present invention. FIG. 8 is a sectional view corresponding to FIG. 7. FIG. 9 is a view illustrating the operation of the straw shown in FIG. 7.

As shown in FIG. 7, the straw, which is denoted by the reference numeral 200, includes a hollow straw body 210 having an elongated rod shape, a bellows portion 220 formed at a desired portion of the straw body 210 while having a desired length, and a tube 230 arranged in the bellows portion 220. In accordance with this embodiment, the tube 230 has a cut-out 232 having a desired shape. The cut-out 232 is formed at an inner tube portion 234 of the tube 230 in a region where the inner tube portion 234 bends. The cut-out 232 is adjacent to the center of curvature of the inner tube portion 234. The cut-out 232 serves to provide an improved passage closing function when the bellows portion 220 bends.

In the illustrated case, the cut-out 232 has a substantially triangular cross-sectional shape having a vertical angle of 90°. Accordingly, when the tube 230 bends by an angle of 90°, the lateral surfaces of the cut-out 232 come into contact with each other while forming a contact line a. At this time, the tip of the contact line a moves toward an outer tube portion 236 of the tube 230, so that it comes into close contact with the outer tube portion 236 in a pressed state.

Although the cross-sections of the straw body 210, bellows portion 220, and tube 230 are illustrated as having a rectangular shape with round corners, that is, an oval shape, as shown in FIG. 3, they may be formed in various shapes such as a polygonal shape, or a circular shape.

Figure 10:
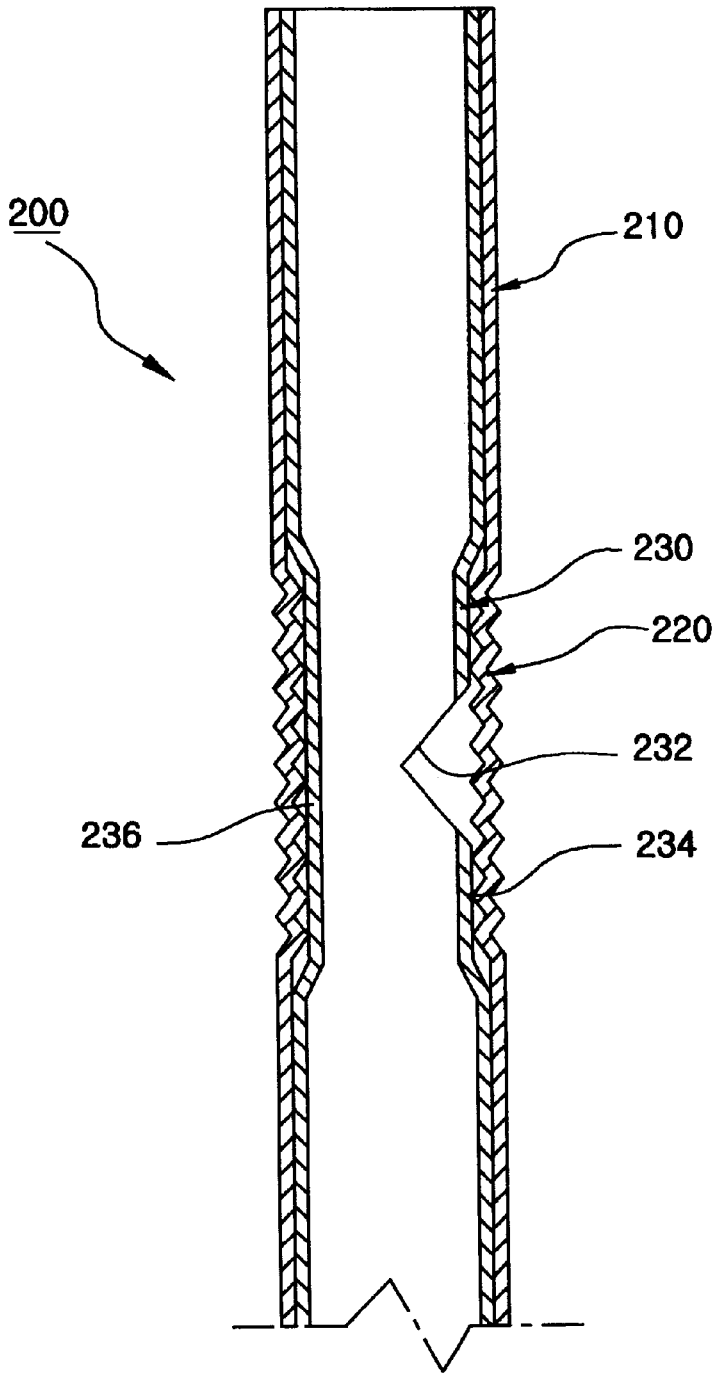
FIG. 10 is a sectional view illustrating a drinking straw with valve function, which has a configuration modified from the straw according to another embodiment of the present invention.

FIG. 10 is a sectional view illustrating a drinking straw with valve function, which has a configuration modified from the straw of FIG. 7 according to another embodiment of the present invention. In this case, the tube 230 having the cut-out 232 extends throughout the length of the straw body 210, so as to allow easy manufacturing of the straw.

In order to mount the straw of FIG. 7 or FIG. 10 to a beverage container, the straw mounting member shown in FIG. 3 or FIG. 6 may be used.

Now, the operation of the straw having the above described configuration according to another embodiment of the present invention will be described in conjunction with FIG. 9. When a user applies a sucking force to the upper end of the straw in a state in which the lower end of the straw has been inserted into a beverage container, liquid flows into the user's mouth via the straw. Where the user subsequently desires to stop drinking, the user bends the bellows portion 220 of the straw. As the bellows portion 220 bends, the tube 230 arranged within the bellows portion 220 also bends in such a fashion that opposite inner surfaces thereof come into close contact with each other, thereby closing the passage of the straw. That is, when the tube 230 bends by 90°, the lateral surfaces of the cut-out 232 come into contact with each other while forming a contact line a. At this time, the tip of the contact line a moves toward the outer tube portion 236 of the tube 230, so that it comes into close contact with the outer tube portion 236 in a pressed state. Accordingly, the passage of the straw is closed.

As described above, since the cut-out 232 is formed at the tube 230, a contact line a is formed in the form of a sharp protrusion by the cut-out 232 when the tube 230 bends. The outer tube portion 236 of the tube 230 comes into contact with the tip of the contact line a in a pressed state. Accordingly, it is possible to effectively close the passage even when liquid is subjected to a high spouting pressure.

As apparent from the above description, the present invention provides a drinking straw with valve function, which has a simplified configuration for holding and releasing the upper portion of the straw, so that it allows an easy mounting of the straw to a beverage container, a convenience in use, and an improved appearance.

According to the present invention, the tube bends easily because of the cut-put formed on the tube. Accordingly, a user can easily manipulate the straw when bending it. In particular, since the outer tube portion comes into contact with the inner tube portion in a pressed state, thereby firmly closing the passage. Accordingly, sealing effect in the container increases, so as to maintain taste of the beverage contained in the container. It is also possible to address the problem of liquid spouting.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A drinking straw with valve function adapted to be mounted to a beverage container, the straw comprising a straw member including a straw body having a passage defined therein, a bellows portion formed at a desired portion of the straw body, and a tube arranged in the bellows portion while being integral with the straw body and having a desired elasticity, said tube providing a passage closing function when the bellows portion bends further comprising:

a straw mounting member for mounting the straw member to the beverage container, the straw mounting member including a fixed base attached to a top of the beverage container while being in close contact with the top of the beverage container, a straw fitting section formed at one side portion of the fixed base, and adapted to mount the straw body thereto, and a straw holding section formed at the other side portion of the fixed base, and adapted to hold the straw member in a bent state or to release the straw member on the bent state.

2. The straw according to claim 1, wherein:

the straw fitting section comprises a straw fitting hole formed at the fixed base, and a protrusion extending downwardly from a lower surface of the fixed base around the straw fitting hole; and the straw holding section comprises a pair of hooks extending upwardly from an upper surface of the fixed base while facing each other, the hooks having a desired elasticity.

3. The straw according to claim 1, wherein a packing member is installed at the straw fitting section so that it is interposed between an inner surface of the straw fitting section and a corresponding outer surface portion of the straw member in order to provide an improved sealing effect between the straw and the beverage container, while firmly fitting the straw member in the straw fitting section.

4. The straw according to claim 1, wherein the straw member is integrally formed with the straw fitting section of the straw mounting member.

5. A drinking straw with valve function comprising a hollow straw body having a passage defined therein, a bellows portion formed at a desired location of the straw body while having a desired length, and a tube arranged in the bellows portion, further comprising:

a cut-out formed at an inner tube portion of the tube in a region where the inner tube portion bends, the cut-out having a desired shape while serving to provide an improved passage closing function when the bellows portion bends.

6. The straw according to claim 5, wherein the cut-out has a substantially triangular cross-section so that when the tube bends by an angle of 90°, lateral surfaces of the cut-out come into contact with each other while forming a contact line moving toward an outer tube portion of the tube, whereby the contact line comes into close contact with the outer tube portion in a pressed state at a tip thereof.

7. The straw according to claim 5, wherein the tube has the same length as the straw body.

8. The straw according to claim 5, further comprising:

a straw mounting member for mounting the straw member to a beverage container, the straw mounting member including a fixed base attached to a top of the beverage container, a straw fitting section formed at one side portion of the fixed base, and adapted to mount the straw body thereto, and a straw holding section formed at the other side portion of the fixed base, and adapted to hold the straw body in a bent state or to release the straw member from the bent state.

* * * * *

UNITED STATES PATENT AND TRADEMARK OFFICE

CERTIFICATE OF CORRECTION

PATENT NO. : 6,745,949 B2
DATED : June 8, 2004
INVENTOR(S) : Kyou Sang Lee

It is certified that error appears in the above-identified patent and that said Letters Patent is hereby corrected as shown below:

Title page,
Item [*] Notice, delete “by152.days”, insert -- by 208 days --

Signed and Sealed this

Nineteenth Day of April, 2005

JON W. DUDAS
*Director of the United States Patent and Trademark Office*